US005476295A

United States Patent [19]

Smallegan et al.

[11] Patent Number: 5,476,295

[45] Date of Patent: Dec. 19, 1995

[54] DOOR HANDLE MOUNTING ASSEMBLY

[75] Inventors: Jon M. Smallegan; L. C. Derek Chamberlain; Dario Pompeii, all of Colorado Springs, Colo.

[73] Assignee: Schlage Lock Company, San Francisco, Calif.

[21] Appl. No.: 345,106

[22] Filed: Nov. 28, 1994

[51] Int. Cl.[6] ..... E05B 3/00

[52] U.S. Cl. ..... 292/336.3; 292/348

[58] Field of Search ..... 292/336.3, 336.5, 292/348, 357, 352

[56] References Cited

U.S. PATENT DOCUMENTS

| | | | |
|---|---|---|---|
| 809,425 | 1/1906 | Caley . | |
| 3,075,796 | 1/1963 | Russell et al. | 292/336.3 |
| 4,042,268 | 8/1977 | Coglan . | |
| 4,481,798 | 11/1984 | Inada . | |
| 4,569,547 | 2/1986 | Fayerman et al. . | |
| 4,667,994 | 5/1987 | Foshee . | |
| 4,671,089 | 6/1987 | Fleming et al. . | |
| 4,784,418 | 11/1988 | Pearson et al. . | |
| 5,067,758 | 11/1991 | Fann et al. . | |

FOREIGN PATENT DOCUMENTS

| | | | |
|---|---|---|---|
| 595110 | 11/1947 | United Kingdom | 292/348 |
| 962771 | 1/1964 | United Kingdom | 292/336.3 |

*Primary Examiner*—Rodney M. Lindsey

*Attorney, Agent, or Firm*—Keith F. Noe; Victor M. Genco, Jr.; Robert F. Palermo

[57] ABSTRACT

A door handle mounting assembly capable of being mounted on a door includes a lock platform having an opening formed therein and a handle mounted on the lock platform without the need of mechanical fasteners, staking or welding. More specifically, the handle has a gripper portion which is grasped by a person's hand for turning the handle, and a shaft portion which is attached at one of its ends to the gripper portion. The shaft portion extends through the opening of the lock platform and has a circumferential groove formed therein. A retaining collar having an annular wall is positioned to engage the lock platform, the collar having an inwardly projecting annular ring connected to the annular wall. The assembly also includes a driver cam having a housing with a hollow boss extending through the opening of the lock platform along a longitudinal axis. The hollow boss has a circumferential groove formed therein which receives the annular ring of the retaining collar for axially retaining the driver cam with respect to the lock platform. The housing also has an aperture formed therein in communication with the opening of the housing and hollow boss for receiving a catch therethrough. The catch is received within the groove of the shaft portion of the handle for axially retaining the driver cam with respect to the handle.

8 Claims, 2 Drawing Sheets

DOOR HANDLE MOUNTING ASSEMBLY

BACKGROUND OF THE INVENTION

This invention generally relates to door hardware and more particularly to a door handle mounting assembly capable of being mounted on a commercial or retail door.

In commercial and retail door hardware, cylindrical, tubular and mortise locks have two primary handle attachments depending on whether the handle is on the inside of the door or on the outside of the door. The number of handles increases when the styling is non-symmetric and left-hand and right-hand variations are required.

Presently, there are various methods of attaching the handle to a lock platform of a door handle mounting assembly, such as by mechanical fasteners, staking and welding. In most applications, the attachment method iS usually arranged such that the inside handle may be easily detached from the lock platform, whereas the outside handle is difficult or impossible to remove for security purposes. Thus, the outside handle is often staked or welded to the platform for providing the necessary strength of connection.

The advent of an improved lock platform which separates the axes of rotation of the handle and lock cylinder has created an opportunity for an improved handle mounting assembly which does not require permanently affixing the handle to the lock platform.

The foregoing illustrates limitations known to exist in present door handle mounting assemblies. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a door handle mounting assembly capable of being mounted on a door, said mounting assembly comprising a lock platform having a generally planar face plate and an outer peripheral edge margin extending generally perpendicularly away from the face plate and towards the door when mounting the lock platform on the door. The face plate extends along a vertical plane generally parallel with respect to the vertical plane of the door and has an opening formed therein. The assembly also comprises a handle having a gripper portion adapted to be grasped by a person's hand for turning the handle, and a shaft portion attached at one of its ends to the gripper portion. The shaft portion extends along a longitudinal axis and through the opening of the lock platform and has a circumferential groove formed therein. A retaining collar having an annular wall is positioned to engage the face plate of the lock platform. The collar further has an inwardly projecting annular ring connected to the annular wall. The assembly also comprises a driver cam having an annular housing with a hollow boss extending through the opening of the lock platform along the longitudinal axis. The hollow boss has a circumferential groove formed therein which receives the inwardly projecting annular ring of the retaining collar for axially retaining the driver cam with respect to the lock platform. The annular housing and hollow boss have an inner surface defining an opening shaped for receiving the shaft portion of the handle therethrough so that the driver cam rotates when rotating the handle. The housing also has an aperture formed therein in communication with the opening defined by the inner surface of the annular housing and hollow boss, the aperture receiving a catch therethrough. The catch is received within the groove of the shaft portion of the handle for axially retaining the driver cam with respect to the handle.

Accordingly, among the several objects of the present invention are the provision of an improved door handle mounting assembly which securely attaches a handle to a lock platform of the assembly and substantially prohibits the axial movement of the handle; the provision of such an assembly which is applicable for mounting inside and outside door handles; the provision of such an assembly which may be installed for left-hand or right-hand use; the provision of such an assembly having a variety of styling options since the handle is not integral with the lock platform; the provision of such an assembly having improved security through a design feature in the handle which is adapted to fail upon exerting a predetermined force on the handle; the provision of such an assembly having improved reliability due to the reduced number of parts; the provision of such an assembly which does not require special tools for its assembly and disassembly; and the provision of such an assembly which is simple in design and easy to install.

The foregoing and other aspects will become apparent from the following detailed description of the invention when considered in conjunction with the accompanying drawing Figures.

BRIEF DESCRIPTION OF THE DRAWING FIGURES

In the drawings which illustrate the best mode presently contemplated for carrying out the present invention:

Corresponding reference numerals designate corresponding parts throughout the several views of the drawings.

DETAILED DESCRIPTION

Figure 1:
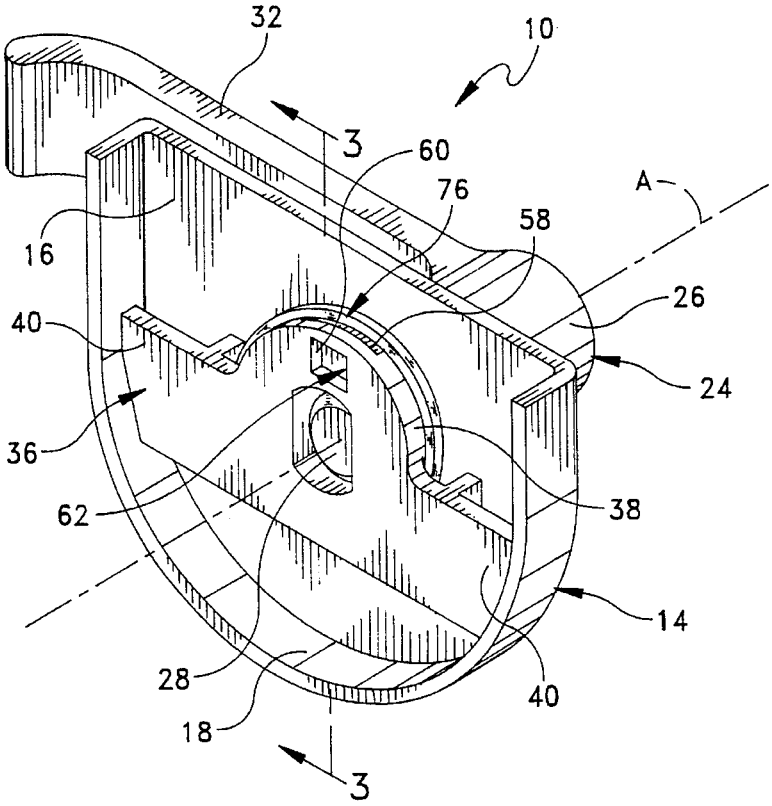
FIG. 1 is a rear perspective view of a door handle mounting assembly of the present invention.

Referring now to the drawings, wherein similar reference characters designate corresponding parts throughout the several views, the embodiment of the apparatus shown in FIG. 1 comprises a door handle mounting assembly 10 for a door 12 of conventional construction according to one embodiment of the invention.

Apparatus 10 comprises a lock platform, generally indicated at 14, having a generally planar face plate 16 (only the bottom portion of the face plate being illustrated in the drawings) lying in a vertical plane parallel to the plane of door 12 and an outer peripheral edge margin 18 which extends from the outer periphery of the face plate 16 generally perpendicularly away from the face plate 16 and towards the door 12 when mounting the lock platform 14 on the door 12. The edge margin 18 of the lock platform 14 engages the door 12 in such a manner that the face plate 16 is spaced from the door 12 thereby creating a space 20 between the face plate 16 and the door 12. As illustrated best in FIG. 3, the lock platform 14 includes a circular-shaped hollow boss 22 integral with and extending away from the face plate 16 in a direction opposite to the direction of extension of the outer peripheral edge margin 18. Preferably the lock platform 14, along with the other components of the mounting assembly 10, is fabricated from rigid metal, such as steel or brass.

Figure 2:
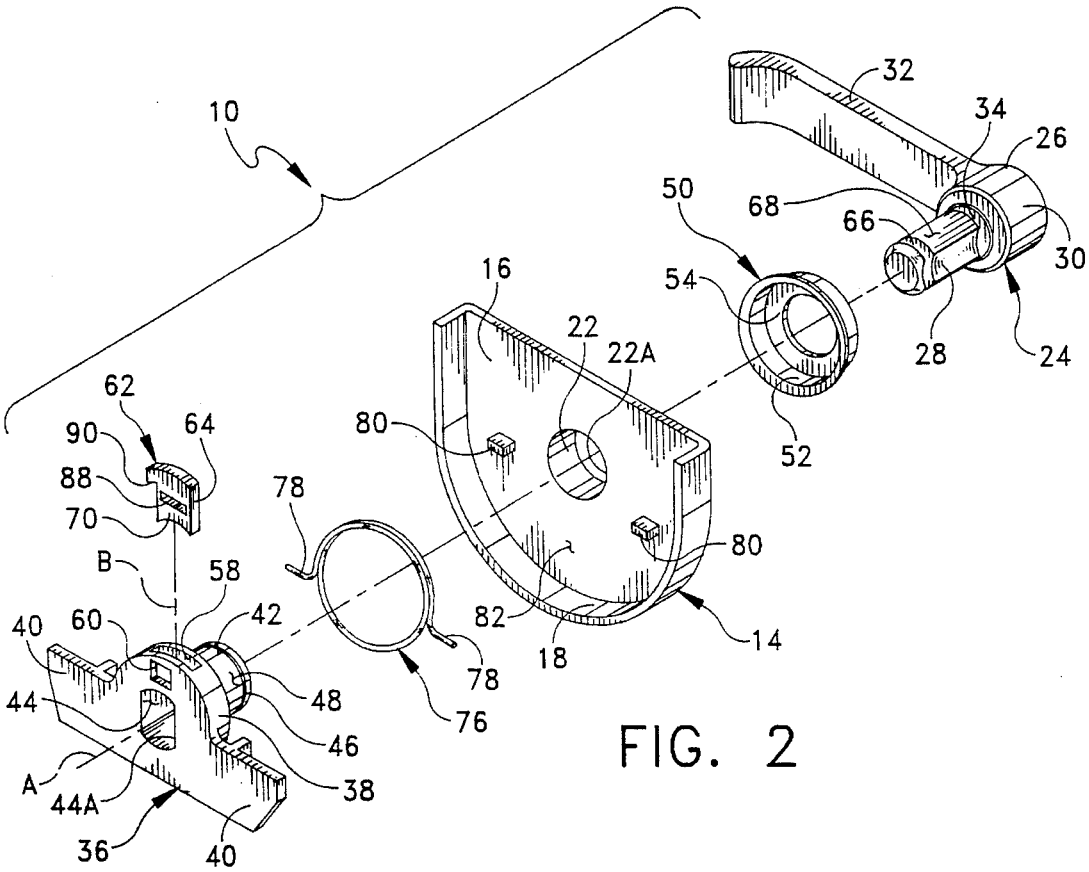
FIG. 2 is an exploded rear perspective view thereof.

Mounting assembly 10 further comprises a handle, generally indicated at 24, having a gripper portion 26 and a shaft portion 28 attached at one of its ends to the gripper portion 26. More specifically, the gripper portion 26 includes a cylindrical member 30 which is integrally attached to the shaft portion 28 and a lever 32 which extends outwardly from one side of the member 30, the lever 32 being designed to be grasped by a person's hand for turning the handle 24. Although a lever 32 is illustrated in the drawings, it should be understood that any member suitable for being grasped by a person's hand, such as a knob, for example, may be substituted for the lever 32. As illustrated throughout the drawings, the shaft portion 28 is received within an opening 22A (FIG. 2) defined by the hollow boss 22 of the lock platform 14 with the gripper portion 26 being positioned outboard with respect to the lock platform 14 when assembling the mounting assembly 10.

The handle 24 further includes a reduced diameter portion 34 at the connection of the shaft portion 28 and the cylindrical member 30 of the gripper portion 26. The reduced diameter portion 34 is designed to fail when a predetermined amount of force is exerted on the lever 32 of the gripper portion 26 of the handle 24. This feature protects the interior components of the mounting assembly 10 located in the space 20 between the face plate 16 of the lock platform 14 and the door 12 when an extraordinary amount of force (e.g., caused by tampering), greater than the predetermined amount of force, is exerted on the handle. Under such circumstances, the member 30 of the gripper portion 26 shears away from the shaft portion 28 at the reduced diameter portion 34.

Figure 3:
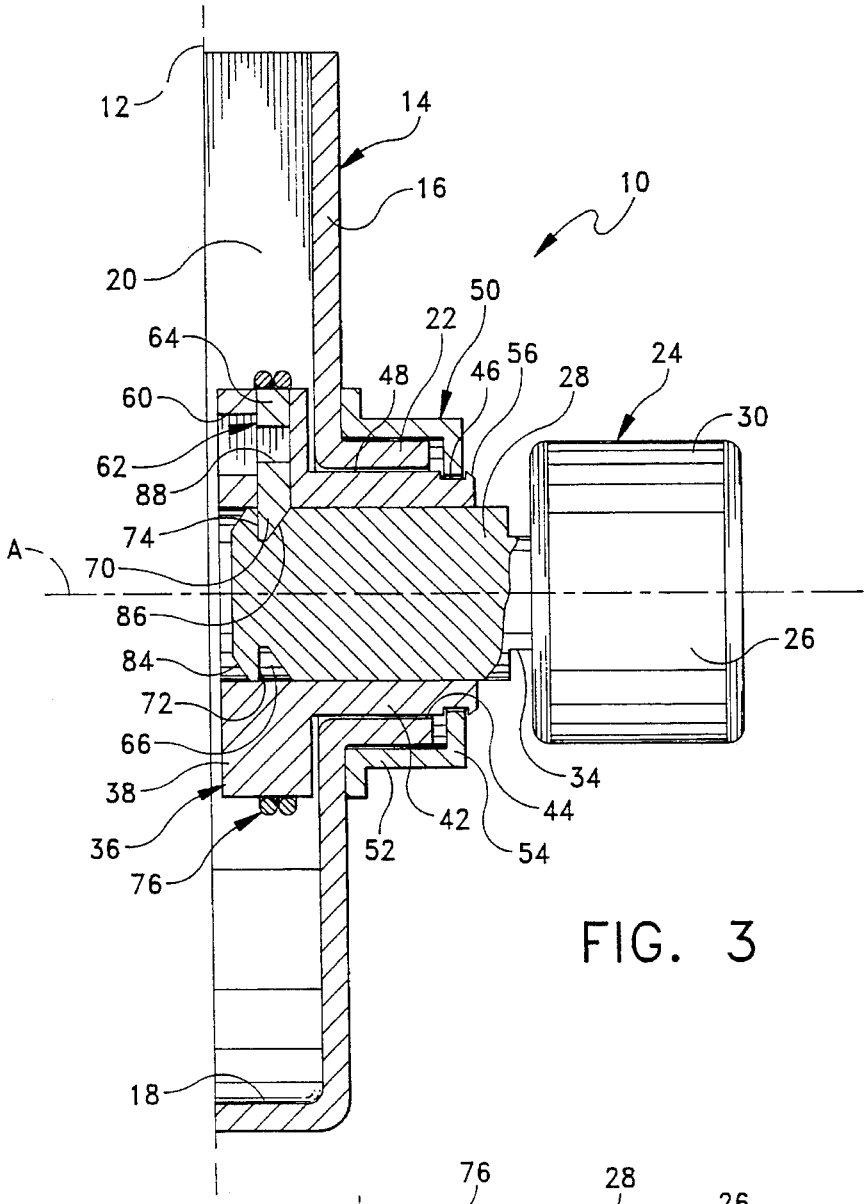
FIG. 3 is a cross-sectional view taken along line 3—3 of FIG. 1.

Generally indicated at 36 is a driver cam having an annular housing 38 with two oppositely extending wings, each indicated at 40, which extend laterally outwardly from opposite sides of the housing 38, and a hollow boss 42 which extends from the annular housing through the hollow boss 22 of the lock platform 14 as illustrated in FIG. 3. The wings 40 of the driver cam 36, when the driver cam 36 is rotated, move a member (not shown) which actuates linkage (not shown) for enabling the door 12 to be opened or closed. Since it is the attachment of the handle 24 to the lock platform 14 which is the key feature of the present invention, it is not necessary to show the other components of the door hardware.

The annular housing 38 and hollow boss 42 are concentrically aligned along a longitudinal axis A to form a continuous inner surface 44 which receives the shaft portion 28 of the handle 24 therein for rotating the driver cam 36 (thereby moving the member upwardly) when the handle 24 is rotated. The inner surface 44 of the annular housing 38 and hollow boss 42 define an opening 44A shaped for receiving the shaft portion 28 of the handle 24 therein so that the driver cam 36 rotates when rotating the handle 24. Preferably, there is a slight clearance fit between the hollow boss 42 of the driver cam 36 and the shaft portion 28 of the handle 24 so that the shaft portion 28 may easily be inserted into the hollow boss 42 and is capable of rotating the driver cam 36.

A circumferential groove 46 is formed in an outer surface 48 of the hollow boss 42 of the driver cam 36 adjacent its free end. A retaining collar, generally indicated at 50, having an annular wall 52 with an axis of rotation about the longitudinal axis A and an inwardly projecting annular ring 54, is provided for axially retaining the driver cam 36 with respect to the lock platform 14. As shown, the annular wall 52 of the retaining collar 50 has a flange (FIG. 3) positioned to engage the face plate 16 of the lock platform 14 and the inwardly projecting annular ring 54 is received in the groove 46 of the hollow boss 42 of the driver cam 36 for axially retaining the driver cam 36 with respect to the lock platform 14. A bevel 56 is formed at the end of the hollow boss 42 of the driver cam 36 for snap-fitting the annular ring 54 of the retaining collar 50 into the groove 46. The hollow boss 42 of the driver cam 36 can be removed from the retaining collar 50 upon exerting a nominal axial force to the retaining collar 50.

The driver cam 36 further includes a rectangularly-shaped, first aperture 58 formed in the annular housing 38 which is in communication with the interior formed by the housing 38 and hollow boss 42. Specifically, the first aperture 58 extends along an axis B extending transversely with respect to the longitudinal axis A from the top of the housing 38. A rectangularly-shaped, second aperture 60 is formed in the housing 38 and extends cross-wise with respect to and in communication with the first aperture 58.

The first aperture 58 is sized for receiving a catch, generally indicated at 62, having a rectangular-shaped body portion 64 which is inserted into the first aperture 58 and into the interior defined by the annular housing 38 and hollow boss 42. The purpose of the catch 62 is to axially retain the driver cam 36 with respect to the handle 24. More specifically, a circumferential groove 66 is formed in the outer surface 68 of the shaft portion 28 adjacent its free end, the groove 66 receiving therein an end portion 70 of the body portion 64 of the catch 62 for axially retaining the driver cam 36 thereto. As best illustrated in FIG. 3, the shaft portion 28 of the handle 24 has a vertical shoulder 72 formed therein which defines part of the circumferential groove 66. The shoulder 72 is positioned to engage a vertical surface 74 of the end portion 70 of the catch 62 for axially retaining the handle 24 to the driver cam 36. When assembled, the body portion 64 of the catch 62 engages the annular housing 38 of the driver cam 36 and the vertical surface 74 of the catch 62 engages the shoulder 72 of the shaft portion 28 of the handle 24 for preventing the axial movement of the handle 24 with respect to the driver cam 36 (and platform 14). Thus, it should be observed that the handle 24 of the present invention, in order to be assembled with the platform 14, does not require mechanical fasteners, staking or welding or any special tools for mounting it on the platform 14.

Figure 4:
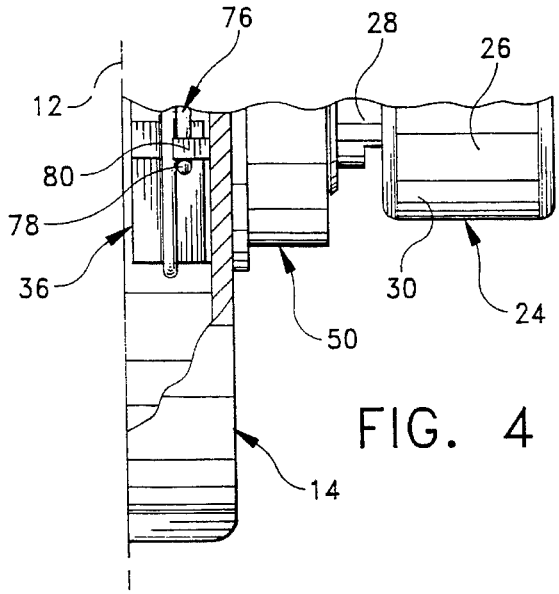
FIG. 4 is a right side elevational view of a detail of the door handle mounting assembly.

A circular-shaped spring 76 is disposed over the annular housing 38 of the driver cam 36 for covering the first aperture 58 and biasing the catch 62 towards the groove 66 of the shaft portion 28 of the handle 24 thereby maintaining the catch 62 in the groove 66. As illustrated, the spring 76 includes two opposite, outwardly extending ends, each indicated at 78, which are positioned to engage two, spaced-apart inwardly extending detents, each indicated at 80, fixedly mounted on an inwardly facing surface 82 of the face plate 16 of the lock platform 14. The detents 80 engage respective ends 78 of the spring 76 for providing a torsional force on the annular housing 38 of the driver cam 36 which enables the handle 24 to return to a neutral position (its illustrated position) after the handle 24 is rotated. FIG. 4 illustrates the engagement of one of the ends 78 of the spring 76 with its respective detent 80.

The end of the shaft portion 28 of the handle 24 further includes a bevelled surface 84 for engaging a mating bevelled surface 86 formed in the end portion 70 of the catch 62, the mating bevelled surface 86 being located opposite to the vertical surface 74. The bevelled surfaces 84, 86 of the shaft portion 28 and catch 62, respectively, are provided so that upon insertion of the shaft portion 28 into the hollow boss 42 of the driver cam 36, the bevelled surface 84 of the shaft portion 28 engages the bevelled surface 86 of the catch 62 to move the catch 62 upwardly against the bias of the spring 76 until the bevelled surface 86 of the catch 62 clears the bevelled surface 84 of the shaft portion 28. Upon clearing the bevelled surface 84 of the shaft portion 28, the spring 76 biases the catch 62 towards the groove 66 thereby axially retaining the shaft portion 28 of the handle 24 to the driver cam 36.

It should be observed that the door handle mounting 10 assembly of the present invention mounts the door handle 24 to the lock platform 14 without having to stake or weld it to the platform or without the need of mechanical fasteners. No special tools are required in order to assemble the mounting assembly 10, which is assembled by slipping the spring 76 over the annular housing 38 of the driver cam 36 and inserting the hollow boss 42 of the driver cam into the opening 22A of the hollow boss 22 of the lock platform 14 in such a manner that the ends 78 of the spring 76 engage the underneath surfaces of the detents 80. The retaining collar 50 is then snap-fitted over the hollow boss 42 of the driver cam 36 wherein the annular ring 54 is positioned within the groove 46 of the hollow boss 42. In this position, the flange of the annular wall 52 of the collar 50 engages the face plate 16 of the lock platform 14 for axially retaining the driver cam 36 with respect to the lock platform 14.

Next, the shaft portion 28 of the handle 24 is inserted through the opening 44A in the driver cam 36, the lever 32 of the handle being positioned for right-hand use (as illustrated throughout the drawings) or left-hand use. To prevent the catch 62 from falling through the first aperture 58, an engaging surface 90 (FIG. 2) formed by a notch cut out of one side of the catch engages a mating engaging surface (not shown) formed in the annular housing 38. As the shaft portion 28 is inserted into the opening 44A, the catch 62 is raised against the downwardly-acting bias of the spring 76 until the end portion 70 of the catch is seated in groove 66 of the shaft portion. At this point the handle 24 is axially retained with respect to the driver cam 36 and the lock platform 14.

In order to disassemble the mounting assembly, an opening 88 is formed in the catch 62 which corresponds to the location of the second aperture 60 of the housing 38 when the catch 62 is received in the groove 66 of the shaft portion 28. The second aperture 60 of the annular housing 38 and opening 88 of the catch 62 are aligned for receiving an implement (not shown) therethrough, such as a flat-blade screwdriver, for raising the catch 62 upwardly against the bias of the spring 76 thus releasing shaft portion 28 of the handle 24 from the driver cam 36. Once the shaft portion 28 is released from the handle and removed from the assembly, the retaining collar 50 may be removed from the hollow boss 42 of the driver cam 36 for separating the driver cam from the platform 14.

While this invention has been illustrated and described in accordance with a preferred embodiment, it is recognized that variations and changes may be made therein without departing from the invention as set forth in the following claims.

Having described the invention, what is claimed is:

1. A door handle mounting assembly capable of being mounted on a door, said mounting assembly comprising:

a lock platform having a generally planar face plate and an outer peripheral edge margin extending generally perpendicularly away from the face plate towards the door when mounting the lock platform on the door, the face plate extending along a vertical plane generally parallel with respect to the vertical plane of the door and having an opening formed therein;

a handle having a gripper portion adapted to be grasped by a person's hand for turning the handle, and a shaft portion attached at one of its ends to the gripper portion, said shaft portion extending along a longitudinal axis and through the opening of the lock platform and having a circumferential groove formed therein;

a retaining collar having an annular wall positioned to engage the face plate of the lock platform and an inwardly projecting annular ring connected to the annular wall;

a driver cam having an annular housing with a hollow boss extending through the opening of the lock platform along said longitudinal axis, said hollow boss having a circumferential groove formed therein which receives the inwardly projecting annular ring of the retaining collar for axially retaining the driver cam with respect to the lock platform, said annular housing and hollow boss having an inner surface defining an opening shaped for receiving the shaft portion of the handle therethrough so that the driver cam rotates when rotating the handle, said housing having an aperture formed therein in communication with the opening defined by the inner surface of the annular housing and hollow boss;

a catch disposed within the aperture of the annular housing, said catch being received within the groove of the shaft portion of the handle for axially retaining the driver cam with respect to the handle.

2. The assembly as set forth in claim 1 further comprising a circular-shaped spring disposed over the annular housing of the driver cam, said spring covering the aperture of the annular housing for biasing the catch towards the groove of the shaft portion of the handle thereby maintaining said catch in said groove.

3. The assembly as set forth in claim 2, said face plate having an inwardly facing surface with two, spaced-apart; inwardly extending detents adapted to engage ends of the spring for providing a torsional force on the annular housing of the driver cam thereby enabling the driver cam to return the handle to a neutral position after the handle is rotated.

4. The assembly as set forth in claim 2, said shaft portion of the handle having a shoulder formed therein which defines part of the circumferential groove, said shoulder engaging a vertical surface of an end portion of the catch for axially retaining the handle to the driver cam.

5. The assembly as set forth in claim 4, said shaft portion of the handle further having a bevelled surface at a free end of the shaft portion, the catch having a mating bevelled surface so that upon inserting the shaft portion into the hollow boss of the driver cam, the bevelled surface of the shaft portion engages the bevelled surface of the catch to move the catch upwardly against the bias of the spring until the bevelled surface of the catch clears the bevelled surface of the shaft portion whereupon the spring biases the end portion of the catch towards the groove of the shaft portion where the shoulder of the shaft portion engages the shoulder of the catch.

6. The assembly as set forth in claim 2, said aperture in the annular housing of the driver cam extending in a direction transverse to the direction of the longitudinal axis.

7. The assembly as set forth in claim 6, said annular housing of the driver cam having a second aperture extending cross-wise with respect to and in communication with the first aperture, said catch having an opening formed therein corresponding to the second aperture when the catch is disposed within the first aperture, said second aperture of the annular housing and opening of the catch being aligned for receiving an implement therethrough for raising the catch against the bias of the spring for releasing the handle from the driver cam.

8. The assembly as set forth in claim 1, said handle comprising a reduced diameter portion at the connection of the shaft portion and gripper portion, said reduced diameter portion being adapted to fail upon exerting a predetermined force on the gripper portion of the handle.

* * * * *